US006976416B2

(12) United States Patent
Ealovega

(10) Patent No.: US 6,976,416 B2
(45) Date of Patent: Dec. 20, 2005

(54) SOLID-STATE FULL AUTO SEAR

(75) Inventor: George D. Ealovega, Vero Beach, FL (US)

(73) Assignee: Crystal Design, LLC, Portland, ME (US)

( * ) Notice: Subject to any disclaimer, the term of this patent is extended or adjusted under 35 U.S.C. 154(b) by 0 days.

(21) Appl. No.: 10/349,206

(22) Filed: Jan. 22, 2003

(65) Prior Publication Data

US 2004/0020094 A1 Feb. 5, 2004

Related U.S. Application Data

(60) Provisional application No. 60/352,132, filed on Jan. 23, 2002.

(51) Int. Cl.[7] ..... F41A 19/66

(52) U.S. Cl. ..... 89/141; 89/129.01; 89/131; 89/135

(58) Field of Search ..... 42/1.01; 89/129.01, 89/129.02, 131, 135, 141, 142

(56) References Cited

U.S. PATENT DOCUMENTS 3,045,555 A * 7/1962 Stoner ..... 89/142
3,748,960 A * 7/1973 Mindel ..... 89/135
5,083,392 A * 1/1992 Bookstaber ..... 42/84
5,379,677 A 1/1995 Ealovega et al. ..... 89/130
5,485,776 A 1/1996 Ealovega ..... 89/130
5,570,814 A 11/1996 Havlovitz ..... 89/131
5,713,150 A * 2/1998 Ealovega ..... 42/84
D400,954 S 11/1998 Ealovega ..... D22/104

* cited by examiner

*Primary Examiner*—Stephen M. Johnson
(74) *Attorney, Agent, or Firm*—Perman & Green, LLP

(57) ABSTRACT

A firing mechanism includes a hammer, an electrical solid-state full auto sear positioned to engage the hammer in a first electrical state and to disengage from the hammer in a second electrical state, and a controller connected to the electrical solid-state full auto sear for causing the electrical solid-state full auto sear to change from the first electrical state to the second electrical state. The controller may include circuitry for causing the electrical solid-state full auto sear to change from the first electrical state to the second electrical state at a predetermined rate, a predetermined number of times, or for a predetermined period of time. The hammer may include a retractable hammer bent for engagement with the electrical solid-state full auto sear, and the electrical solid-state full auto sear may include a piezoelectric device.

19 Claims, 13 Drawing Sheets

SOLID-STATE FULL AUTO SEAR

CROSS-REFERENCE TO RELATED APPLICATION(S)

This application claims the benefit of U.S. Provisional Application No. 60/352,132, filed Jan. 23, 2002, which is incorporated by reference herein in its entirety.

BACKGROUND OF THE INVENTION

1. Field of the Invention

The present invention relates to controlling the firing of a weapon, and, more particularly, to controlling the firing rate, number of times, and time period of a weapon.

2. Brief Description of Related Developments

Automatic weapons have a known tendency toward reduced control and accuracy when firing in fully automatic mode. This problem is primarily associated with automatic weapons with excessively high rates-of-fire. All weapons experience some degree of muzzle-rise due to recoil. When the rate of full-auto-fire exceeds a certain optimal rate for a particular weapon design, the muzzle no longer has sufficient time to return to the original point of aim between successive rounds, thus causing the weapon to progressively "climb" away from the original point of aim. This results in wasted ammunition and, more importantly, the possible unintentional hitting of objects other than the intended target. This control problem is compounded by the desire to reduce the size and weight of newly developed weapons. In particular, while a reduction in weight makes a weapon easier to transport, applicable to a larger user population, less weapon mass can also decrease stability and control during full-auto-fire. The laws of physics dictate that reducing the size, weight, and travel distance of a weapon's bolt or other working components, will also result in a faster action, with a corresponding increase in the rate-of-fire and therefore a detrimental increase in weapon "climb".

A properly designed electronic rate-control-mechanism would allow a weapon designer to first determine and then employ the precise optimal rate-of-fire relative to that weapon's stability, control and hit-probability. This predetermined rate-of-fire would be totally independent of the physical size and mass of the weapons components, thus allowing for extremely small and lightweight weapon designs. An added advantage of such a rate control mechanism system would be the ability to precisely employ multiple rates-of-fire and multiple modes-of-fire in the same weapon to meet specific end-user requirements.

For an electronic rate-control mechanism to be acceptable to the military, there are at least three basic design requirements which must be addressed. First, the electronic rate-control mechanism must be independent, in that should any failure occur within the electronic rate-control device, the weapon must remain capable of discharging rounds of ammunition. Second, the rate-control mechanism must be capable of being retrofitted to an existing weapon, with an absolute minimum amount of alteration. The simpler and smaller the device in terms of components, the more practical and acceptable it will be to the military. Third, also related to simplicity, the mechanism must be cost effective, both in terms of materials and actual retrofitting. The rate-control-device to be described meets these important basic requirements. U.S. Pat. Nos. 5,379,677, 5,485,776, 5,713,150, and 5,770,814 to Ealovega, et al, incorporated by reference herein, disclose various techniques for controlling the firing rate of an automatic weapon by controlling the movement of the bolt of the weapon.

SUMMARY OF THE INVENTION

In one embodiment, the present invention is directed to a firing mechanism including a hammer, an electrical solid-state full-auto-sear positioned to engage the hammer in a first electrical state and to disengage from the hammer in a second electrical state, and a controller connected to the electrical solid-state full-auto-sear for causing the electrical solid-state full-auto-sear to change from the first electrical state to the second electrical state.

The controller may include circuitry for causing the electrical solid-state full-auto-sear to change from the first electrical state to the second electrical state at a predetermined rate, a predetermined number of times, or for a predetermined period of time. The hammer may include a retractable hammer bent for engagement with the electrical sear, and the electrical sear may be a one piece member piezoelectric device. In the first electrical state the piezoelectric device may move the electrical full auto sear in a first direction to cause the front extension to engage the hammer, and in the second electrical state the piezoelectric device may move the electrical full auto sear to cause the front extension to disengage from the hammer.

In another embodiment, the present invention is directed to a method of firing a weapon including engaging a hammer with an electrical solid-state full-auto-sear in a first electrical state, disengaging the electrical solid-state full-auto-sear from the hammer in a second electrical state, and controlling a change from the first electrical state to the second electrical state to control the firing of the weapon. The method may further include causing the electrical solid-state full-auto-sear to change from the first electrical state to the second electrical state at a predetermined rate, a predetermined number of times, or for a predetermined period of time.

The first electrical state may induce a first rotational force on the electrical solid-state full-auto-sear causing the electrical solid-state full-auto-sear to engage the hammer, and the second electrical state may induce a second rotational force on the electrical solid-state full-auto-sear causing the electrical solid-state full-auto-sear to disengage from the hammer.

In still another embodiment, the present invention is directed to a weapon including a firing mechanism. The firing mechanism has a hammer, an electrical solid-state full-auto-sear positioned to engage the hammer in a first electrical state and to disengage from the hammer in a second electrical state, and a controller connected to the electrical solid-state full-auto-sear for causing the electrical sear to change from the first electrical state to the second electrical state. The controller is operable to cause the electrical solid-state full-auto-sear to change from the first electrical state to the second electrical state at a predetermined rate, a predetermined number of times, or for a predetermined period of time.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENTS

Figure 1:
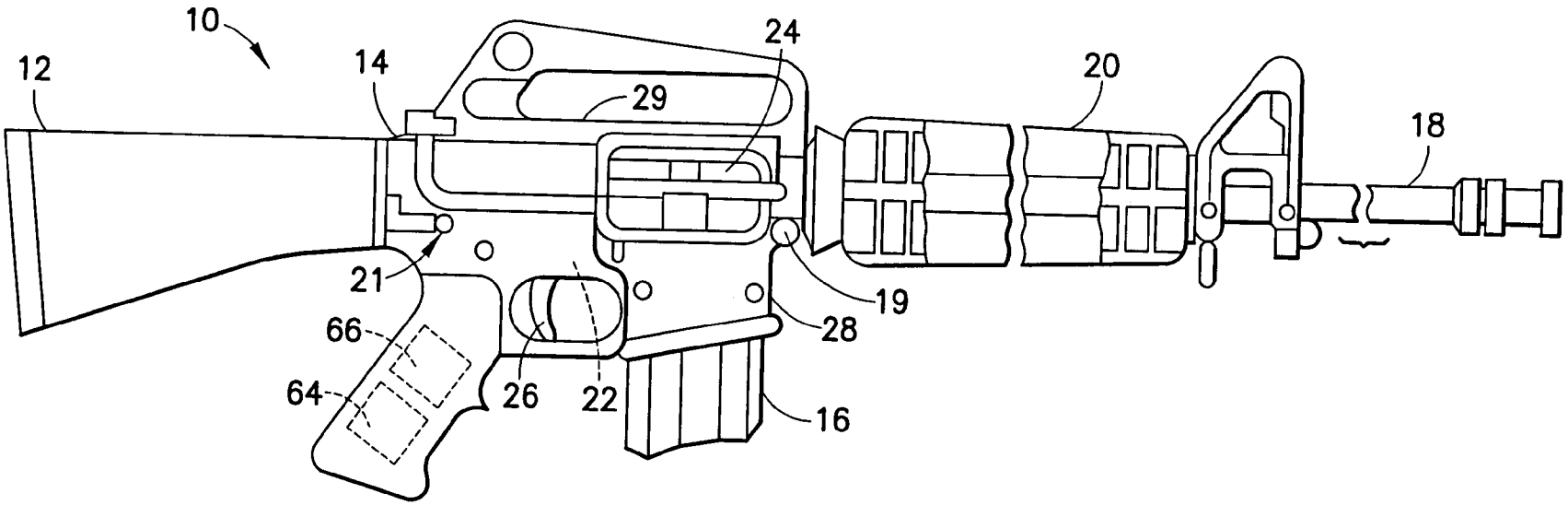
FIG. 1 is an elevational side view of a weapon incorporating features of the present invention.

FIG. 1 shows an elevational side view of a weapon 10 incorporating features of the present invention. The weapon 10 may be similar to an M16/M4 type of rifle used by the United States Armed Forces. Although the present invention is being described with respect to the embodiment shown in FIG. 1, it should be understood that the present invention can be used with any suitable gas operated, blow back, or other type of firearms including assault weapons, machine guns, and submachine guns. In addition, it should also be understood that the present invention may incorporate any suitable size, shape, or type of elements and suitable type of materials without departing from the spirit of the invention.

In the embodiment shown in FIG. 1, the weapon 10 may include a stock 12 mounted on a receiver 14. The receiver 14 has a cartridge magazine 16 mounted therein. A barrel 18 is operatively connected to the receiver 14 and has a handgrip 20 mounted thereupon for isolating a user's hand from direct contact with the barrel 18. The receiver 14 generally houses a firing mechanism 22, which generally includes a bolt assembly 24 and a trigger mechanism 26. The receiver 14 is generally comprised of metal and has a lower receiver 28 and an upper receiver 29 which are held together by two pins or screws 19 and 21. The lower receiver 28 generally houses the trigger mechanism 26 and the upper receiver 29 may be generally provided with a longitudinal cavity or chamber into which the bolt assembly 24 is reciprocally mounted.

Figure 2A:
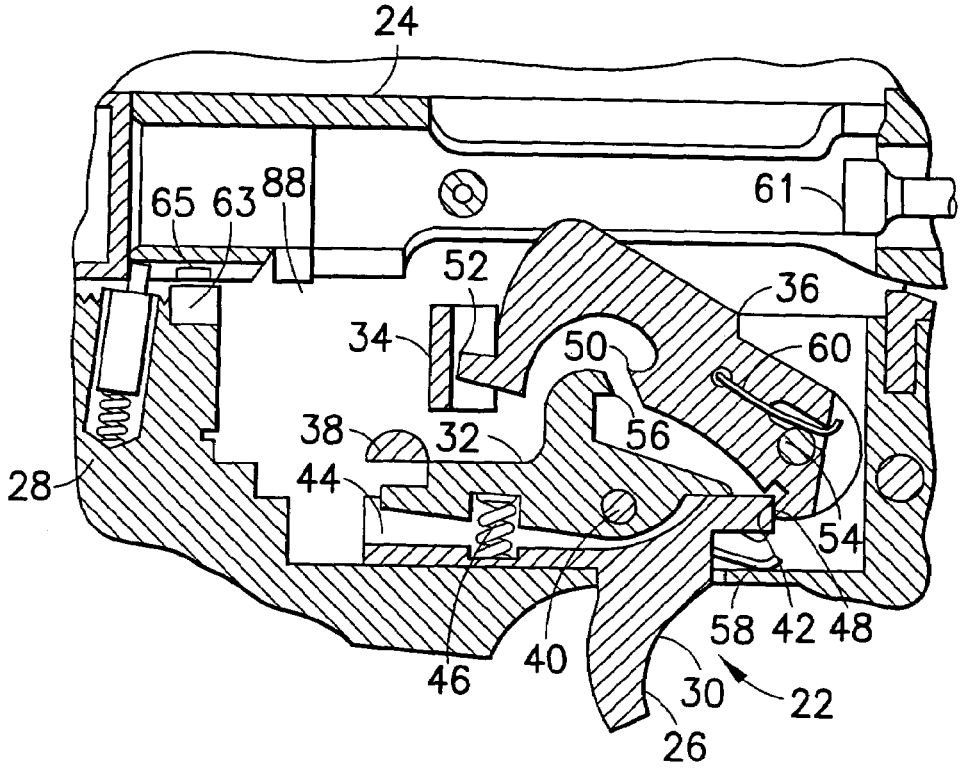
FIG. 2A is a cross-sectional view of a portion of a lower receiver and trigger mechanism of the weapon shown in FIG. 1.

Referring also to FIG. 2A, the trigger mechanism 26 is shown. The trigger mechanism 26 includes a trigger 30, a disconnector 32, and a solid-state full auto sear 34 in accordance with one embodiment of the present invention. The solid-state full auto sear 34 and its operation will be described in detail below.

The bolt assembly 24, trigger 30 and disconnector 32 may be identical to the bolt assembly, trigger, and disconnector in an M16/M4 type of rifle. The firing mechanism 22 may also include a hammer 36 and a selector switch 38 which may be similar to the hammer and selector switch in an M16/M4 type of rifle. When the selector switch 38 is set to a semi-automatic firing setting (see FIGS. 2A and 2B), the trigger 30, disconnector 32 and hammer 36 may function the same as in an M16/M4 type of rifle.

The trigger 30 is pivotally mounted within the lower receiver 28 by a transversely orientated pivot pin 40. The trigger 30 has an elongated upper portion, which includes a forward trigger sear 42 adapted to retain the hammer 36. Additionally mounted on the pivot pin 40 is the disconnector 32. The lower portion of the disconnector 32 is located within a groove 44 in the upper portion of the trigger 30. A compression spring 46 is interposed between the bottom of the groove 44 and the underside of the disconnector 32 in order to urge the rear of the disconnector in an upward direction about the pivot pin 40. The hammer 36 is provided with a first sear abutment 48, a second sear abutment 50, and a third sear abutment 52. The hammer 36 is pivotally mounted to the lower receiver 28 at the pivot pin 54.

Figure 2B:
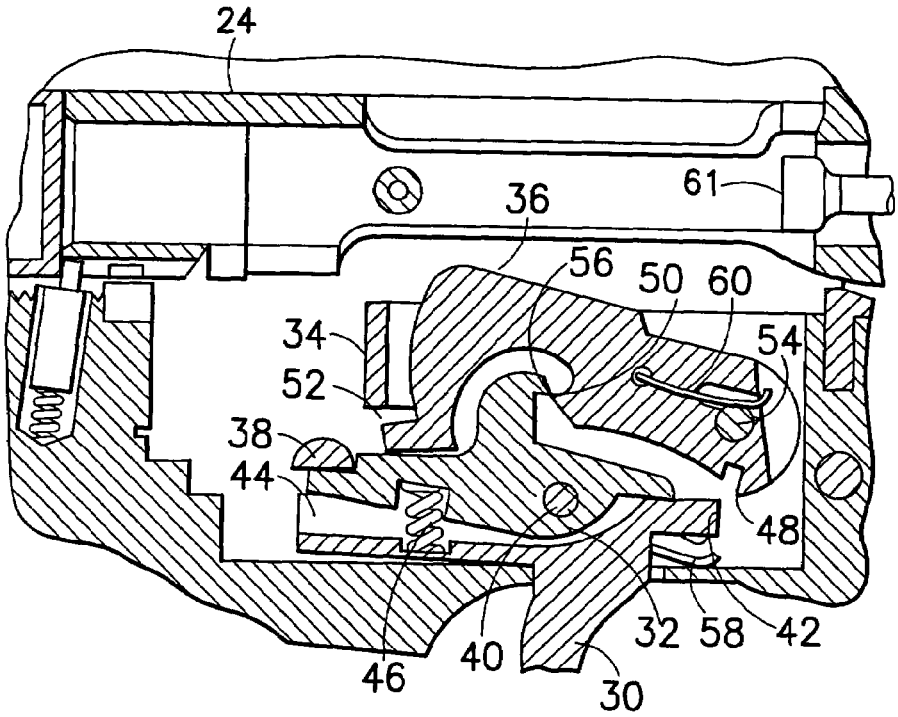
FIG. 2B is a cross-sectional view as in FIG. 2A showing a hammer being caught on a semi-automatic disconnector.

The disconnector 32 includes a vertically extending portion, which includes a hook sear 56. The trigger 30, by virtue of its pivotal mounting on the pin 40, is adapted to pivot from a first position shown in FIG. 2A to a second position shown in FIG. 2B. In the first position shown in FIG. 2A the trigger sear 42 is suitably located to engage the first sear abutment 48 and hold the hammer 36 in its cocked position shown. The selector switch 38 shown in FIG. 2A is set at a semi-automatic firing position. In this position the selector switch 38 allows the rear end of the disconnector 32 to move upward as shown in FIG. 2B.

When the selector switch 38 is set to the semi-automatic position it also may cause the solid state full auto sear 34 to become inoperable, preventing the solid state full auto sear 34 from interacting with the hammer 36.

Upon rearward pivotable movement of the trigger 30 about its pivot pin 40, against the bias of the trigger spring 58, the trigger sear 42 moves down to thereby release the first sear abutment 48. The hammer 36 swings upwardly under the bias of a hammer spring 60 about its pivot pin 54. During upward swinging between its cocked position shown in FIG. 2A and a firing position or battery position in which the hammer 36 contacts the firing pin 61, the hammer 36 passes through a bottom longitudinal aperture or slot in the lower portion of the bolt assembly 24. Upon striking the firing pin 61 a chambered cartridge is fired.

When the bolt assembly 24 recoils, the hammer 36 is urged by the bolt assembly 24 in a downward or counterclockwise direction. Assuming that the trigger 30 has been retained in its depressed position shown in FIG. 2B during this downward movement, the second sear abutment 50 of the hammer 36 engages the hook sear 56 on the disconnector 32 after temporarily displacing the disconnector 32 in a counterclockwise direction about the pivot pin 40. Conversely, if the trigger 30 is immediately returned to its first position after firing of the chambered cartridge, the hammer 36 will be caught by the trigger sear 42 at the first sear abutment 48 to retain the hammer 36 back at its cocked position shown in FIG. 2A.

After the hammer 36 is caught on the hook sear 56 the user must release the trigger 30 in order to fire the firearm again. When the user releases the trigger 30, the trigger sear 42 moves into a path in front of the first sear abutment 48. The trigger 30 also presses upward on the disconnector 32 at the front of the disconnector to thereby pivot the disconnector in a counterclockwise direction.

As the disconnector 32 is rotated in a counterclockwise direction the hook sear 56 disengages from the second sear abutment 50, which releases the hammer 36 from the disconnector 32. The hammer 36 rotates upwards slightly but is held at its cocked position by engagement of the trigger sear 42 with the first sear abutment 48. The user can fire the weapon 10 again by actuating the trigger 30 again.

The trigger 30, disconnector 32, hammer 36, and selector switch 38 may be substantially identical and may function substantially identically to the equivalent components in an M16/M4 type firearm. The semi-automatic firing mechanism may be entirely mechanically controlled by the trigger 30, disconnector 32, springs 46 and 58, and proper location of the selector switch 38. Thus, a user need only pull the trigger 30, in the semi-automatic mode, to release the hammer 36 from its cocked position to a battery position. In an alternate embodiment, a mechanical burst control mechanism could be incorporated with the trigger 30, disconnector 32, and hammer 36 to allow for multiple limited bursts of fire when the trigger 30 is actuated.

Figure 9:
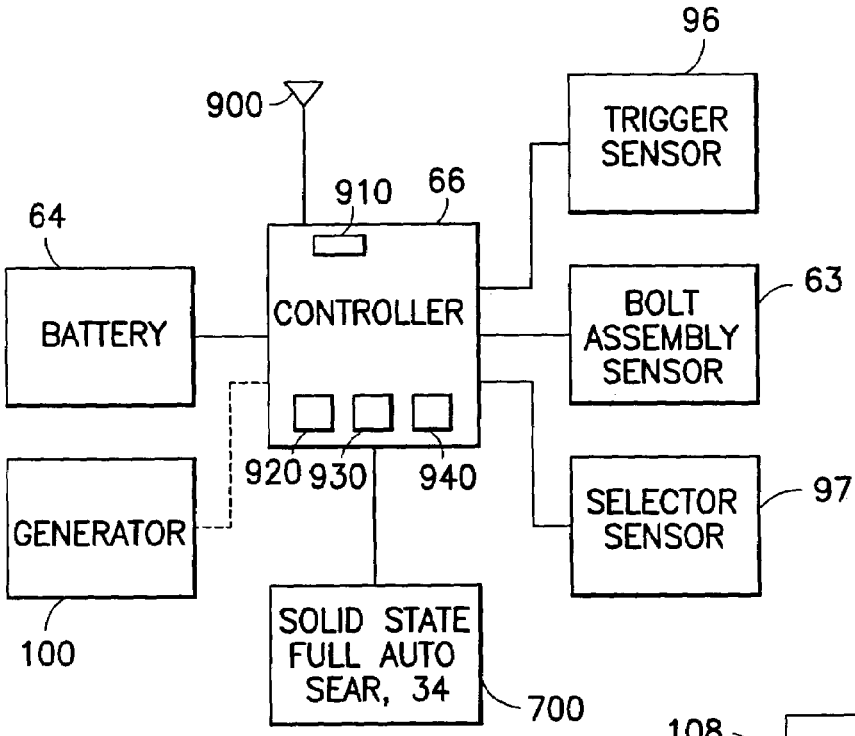
FIG. 9 is a block diagram of an electrical system for use with the present invention.
Figure 10:
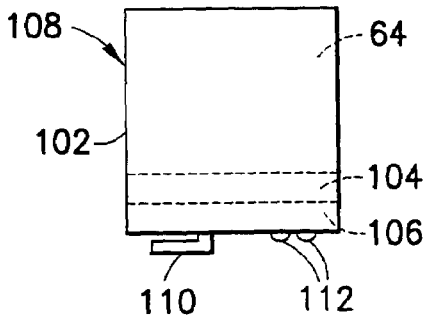
FIG. 10 is a schematic view of a battery for use with the present invention.

As mentioned above, the firing mechanism 22 includes a solid-state full auto sear 34. The firing mechanism 22 may also include a battery 64 (FIGS. 1 and 9) and a controller 66 (FIGS. 1 and 9).

Figure 3A:
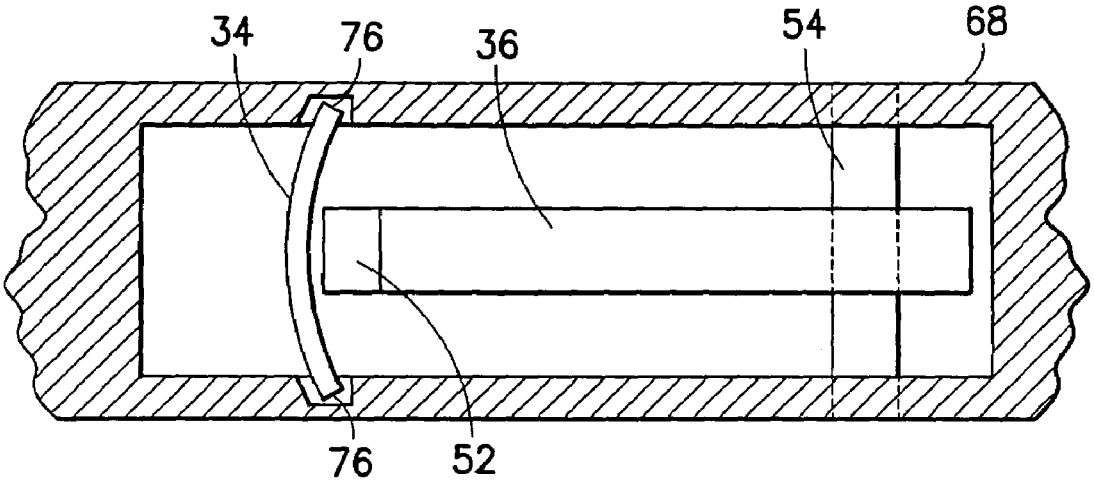
FIGS. 3A–3C show one embodiment of the solid state full auto sear in accordance with the present invention.
Figure 3B:
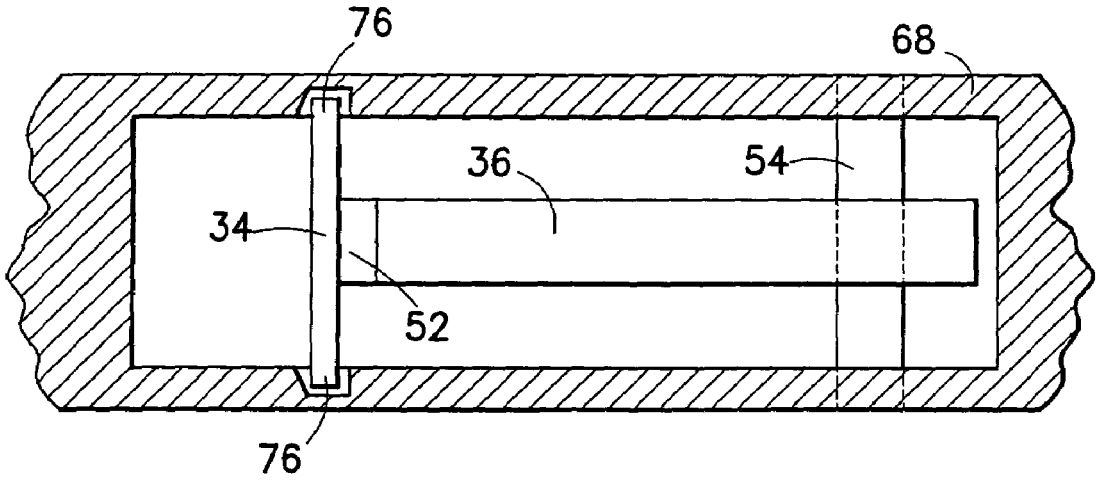
Figure 3C:
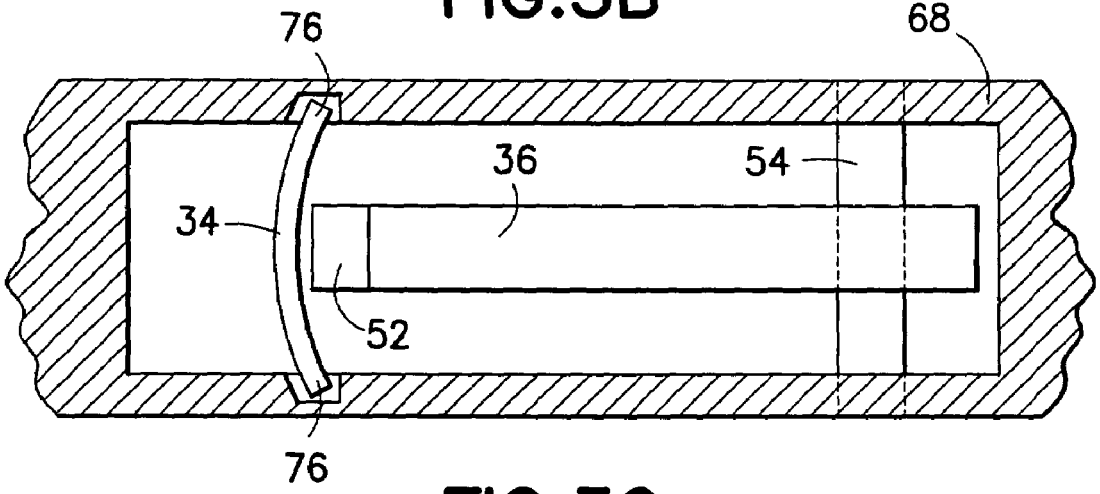

Referring also to FIGS. 3A–3C, the solid-state full auto sear 34 may be mounted in a frame 68. The firing mechanism 22 may also include one or more sensors, for example a bolt assembly sensor 63 (FIGS. 2A and 9) connected to the controller 66. A member 65, such as a magnet, is located on the bolt assembly 24 to actuate the bolt assembly sensor 63. However, in an alternate embodiment, a sensor need not be provided. Alternatively, any suitable type of sensor or switch could be used to indicate to the controller 66 that the bolt assembly 24 is at the battery position and/or that the bolt assembly 24 has cycled after firing of the firearm or previous actuation of the mechanism 62. Rather than sense the movement or position of the bolt assembly 24, the sensor could sense the location or movement of the hammer 36, or the trigger 30.

The solid state full auto sear 34 may generally comprise a piezoelectric material that assumes at least two different shapes corresponding to a charged or energized state and an uncharged or un-energized state, respectively. The shapes may include for example, a generally bowed shape and a generally flat shape. The solid state full auto sear 34 may be movably captured by slots 76 in the frame 68 which may still allow the solid state full auto sear 34 to change shape when charged. The solid state full auto sear 34 may be comprised of piezoelectric material for example, as described in Thunder® White Paper, (Face International Corporation, Feb. 21, 2001) and Application Notes, Thunder ®, (Face International Corporation, 2002) and designated as Model TH8-R.

The solid state full auto sear 34 is located so that in one state, charged or uncharged, it is not in a position to engage the third sear abutment 52 of hammer 36, and in the opposite state it is in a position to engage the third sear abutment 52 of hammer 36.

The solid-state full auto sear 34 is electrically connected to the battery 64 by means of the controller 66. The controller 66 may include a microprocessor. In an alternate embodiment, any suitable type of controller could be provided. Referring also to FIG. 9, a block diagram of the electrical system used in the weapon 10 is shown. The sensors 63, 96, 97 are connected to the controller 66. The controller 66 controls the supply of electricity from the battery 64 to the solid-state full auto sear 34. The controller 66 may include circuitry 920 for applying a charge to the solid-state full auto sear 34 at a predetermined rate. The controller 66 may also include circuitry 930 for applying a charge to the solid state full auto sear 34 a predetermined number of times, corresponding to a number of rounds to be fired. The controller 66 may also include circuitry 940 for applying a charge to the solid-state full auto sear 34 for predetermined period of time.

The electrical system could also include a generator 100 for generating electricity, such as another piezoelectric member that is deformed by the bolt assembly to generate electricity. Generator 100 could also replace the battery 64. However, any suitable electrical system could be provided.

In one embodiment, the controller may also include an antenna or other device 900 for detecting an electromagnetic signal and a receiver 901 for receiving and conditioning the signal for use by controller 66. For example, controller 66 may receive radio or other types of signals and control weapon 10 in response to those signals.

Figure 4A:
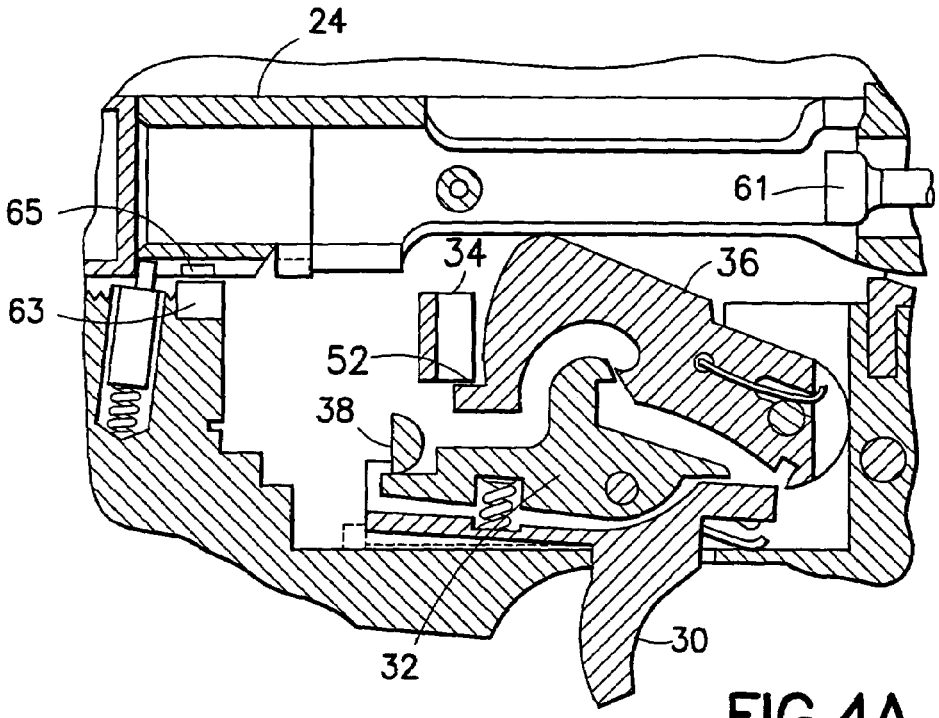
FIGS. 4A and 4B are cross-sectional views of a portion of a lower receiver and trigger mechanism showing the operation of one embodiment of the present invention.
Figure 4B:
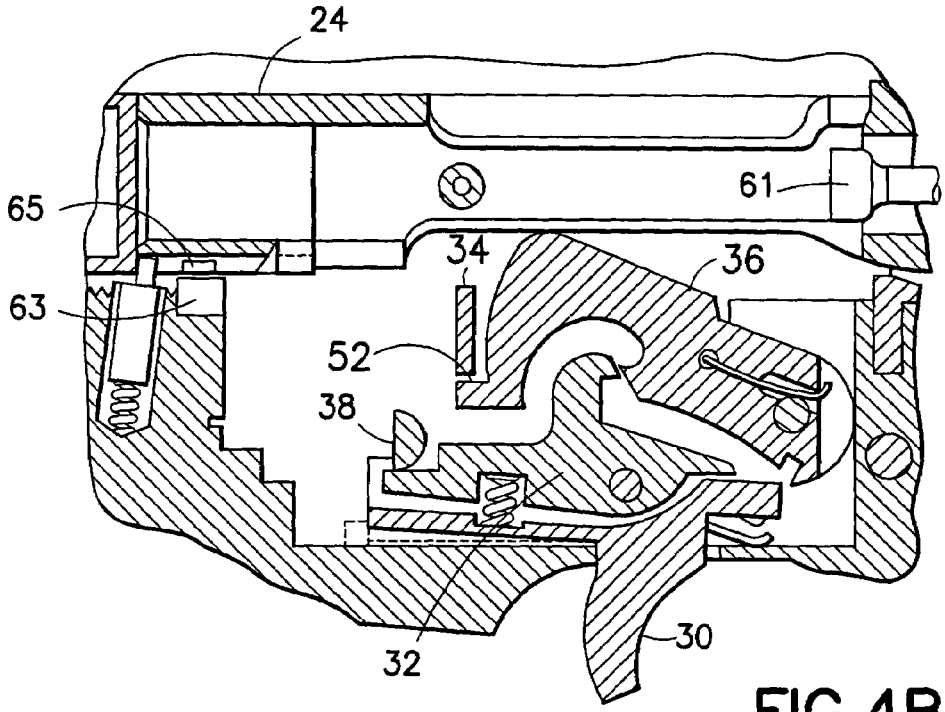

Referring to FIGS. 2A, 2B, 3A, and 3C, when the selector switch 38 is in its semi-automatic position, the solid state full auto sear 34 is inoperable and prevented from interacting with the hammer 36 by way of its positioning and shape. However, when the selector switch 38 is moved to the automatic position, as shown in FIGS. 4A and 4B, the solid state full auto sear 34 is operable and capable of engaging hammer 36 under the control of controller 66 (FIG. 9). The selector switch 38, when set to its automatic position, also keeps the semi-automatic disconnector 32 from engaging the hammer 36.

Referring to FIGS. 3A and 4A, the solid-state full auto sear 34 is shown at one example of a home position. In this exemplary home position, the solid-state full auto sear 34 is uncharged and bowed to a position where it does not engage third sear abutment 52 of hammer 36.

In the embodiment shown, a first round has been mechanically fired, the bolt assembly 24 has cycled and the hammer 36 is still in its most rearward position of rotation, about to return to its battery position. The weapon's selector switch 38 is in a full-auto or burst fire position and the trigger 30 has been mechanically disengaged from the hammer 36, which in turn has struck the firing pin 61 and caused a first mechanical discharge of the weapon 10. The bolt assembly 24 has traveled to its most rearward position and returned to battery, having rotated the hammer 36 to its most rearward position in the process. Sometime between the release of the hammer 36 and its rotation to its most rearward position, the sensor 63 has been activated by a specific event such as movement of or contact with member 65, bolt assembly 24, trigger 30, or hammer 36.

Referring now to FIGS. 3B and 4B, before the hammer 36 has begun to return to its battery position, the controller 66, activated by the sensor 63, has sent a charge to the solid-state full auto sear 34, causing the solid state full auto sear 34 to assume its hammer retaining condition (in this example, a flat shape) in sufficient time to engage and retain the hammer 36. Each time the sensor is activated, the controller 66 may determine that a round has been fired and may count or record the number of rounds fired as part of a particular burst or a particular time period.

Referring again to FIGS. 3A and 4A, the controller 66 has now discontinued the charge being applied to the solid-state full auto sear 34, causing it to reassume its bowed, uncharged, hammer-release condition, thereby causing a subsequent round to be fired.

In this example, the controller 66 may send a charge to the solid-state full auto sear 34 for a predetermined period of time measured from a specific event, before discontinuing the charge. It is this predetermined interval, which determines the cyclic rate of fire of the weapon 10 in full-auto or burst mode. This cyclic rate can be any rate at or below the natural, uncontrolled cyclic rate of the weapon 10. The released hammer 36 now causes a subsequent round to be fired, causing the bolt assembly 24 and the hammer 36 to once again cycle, with the hammer 36 once again being momentarily retained by the solid state full auto sear 34. This sequence of events may continue as long as the trigger 30 remains in a pulled or firing position or until all rounds in the magazine have been discharged or until the controller 66, causes the firing to cease after a set number of rounds.

Thus, the controller 66 may be capable of controlling the solid state full auto sear 34 such that the weapon 10 may fire at any desired rate up to the weapon's natural cyclic firing rate. The controller 66 may also be able to control the solid state full auto sear 34 such that a predetermined number of rounds may be fired per burst, from zero per burst to any number of rounds per burst. The controller 66 may further include a round counting capability for controlling the number of rounds per burst. For example, the controller 66 may operate the solid state full auto sear 34 to fire one, two, three, or any number of rounds per burst in combination at 100, 200, 300, 450, or any other number of rounds per second. In one embodiment, the controller may recognize the number of rounds fired by identifying the number of times any of the sensors have been activated.

Figure 5A:
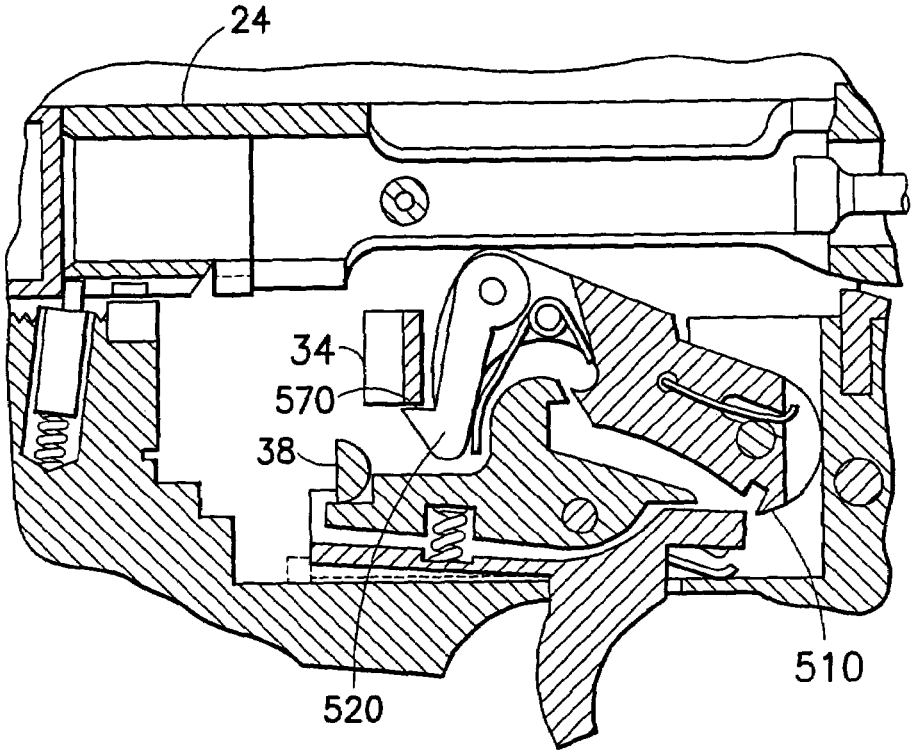
FIGS. 5A–5D are cross sectional views showing an embodiment of the present invention employing a hammer bent.

Turning to FIG. 5A, another embodiment of the invention is shown that employs a different hammer 510 having a retractable hammer bent 520. This embodiment is advantageous in that it allows the solid-state full auto sear 34 to achieve its hammer-engagement condition earlier in the sequence of events, without causing an obstruction to the full, rearward rotation of the hammer 510.

In this embodiment, the solid-state full-auto-sear 34 is positioned such that it engages and retains the hammer 510 in the uncharged condition, in contrast to the embodiment shown in FIGS. 3A–3C, 4A, and 4B where the solid state full auto sear 34 engages the hammer 36 in its charged condition. The retractable hammer bent 520, or any similarly functioning feature, allows the hammer 510 to rotate past the solid-state full-auto-sear 34 so that the hammer 510 may then be retained by the solid-state full-auto-sear 34.

Figure 6A:
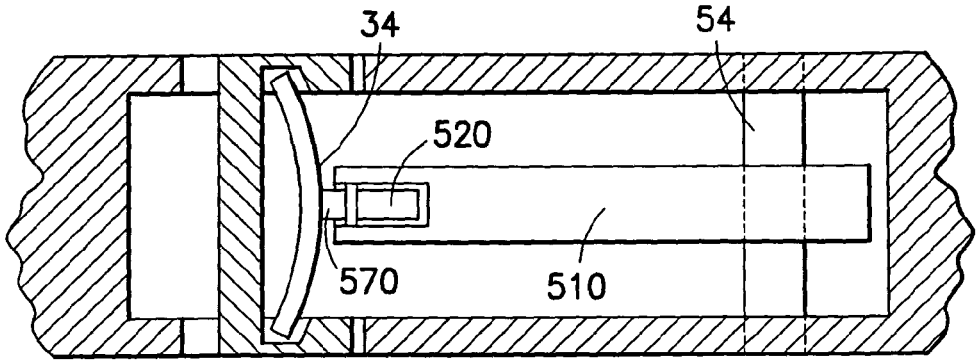
FIGS. 6A–6E show a top view of the embodiment in FIGS. 5A–5D.

FIGS. 5A and 6A show a cross-sectional side and top view, respectively, of a portion of the lower receiver 28 and trigger mechanism 26. The solid-state full auto sear 34 is in a hammer-retaining, uncharged condition and position. A first round has been mechanically fired, the bolt assembly 24 has cycled and caused the hammer 510 to engage and be retained by the solid-state full auto sear 34. In this embodiment, the solid-state full auto sear 34 is bowed in its uncharged state and flattens when a charge is applied. In alternate embodiments, the solid-state full auto sear 34 may have different shapes in the charged and uncharged states. The weapon's selector switch 38 is in a full-auto or burst fire position, and the trigger 30 has been mechanically disengaged from the hammer 510, which in turn has struck the firing pin and caused a first mechanical discharge of the weapon 10. The bolt assembly 24 has traveled to its most rearward position and returned to battery, having rotated the hammer 510 to its most rearward position in the process, causing the hammer 510 to be retained by the solid-state full-auto-sear 34. Sometime between the release of the hammer 510 and its rotation to its most rearward position, one or more of the sensors 63, 96, 97 are activated by a specific event, for example, movement of or contact by the bolt assembly 24, hammer 510, or trigger 30.

Figure 5B:
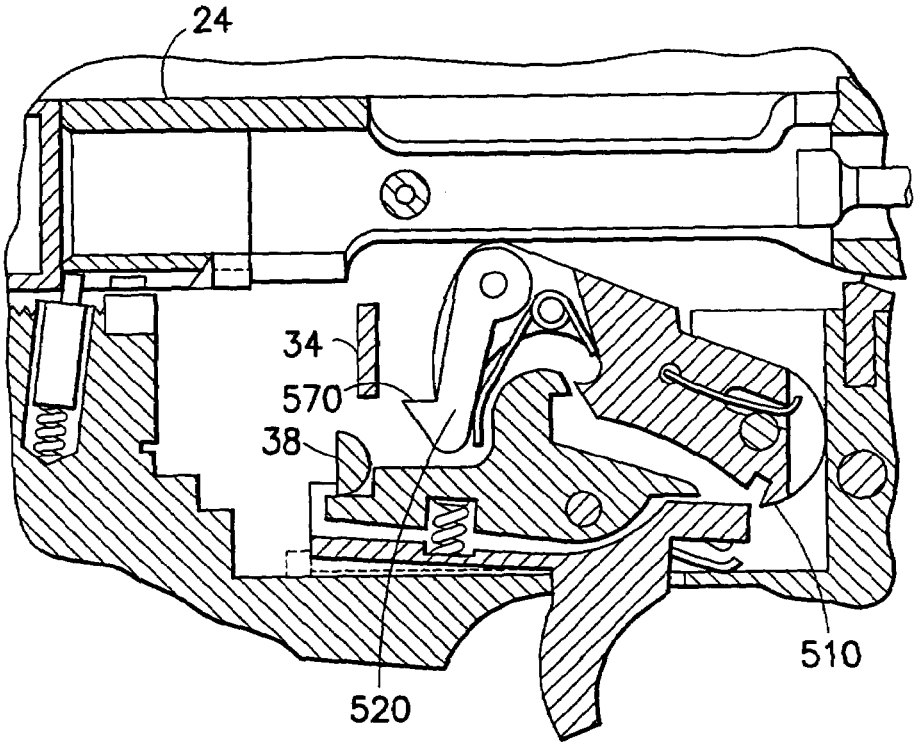
Figure 6B:
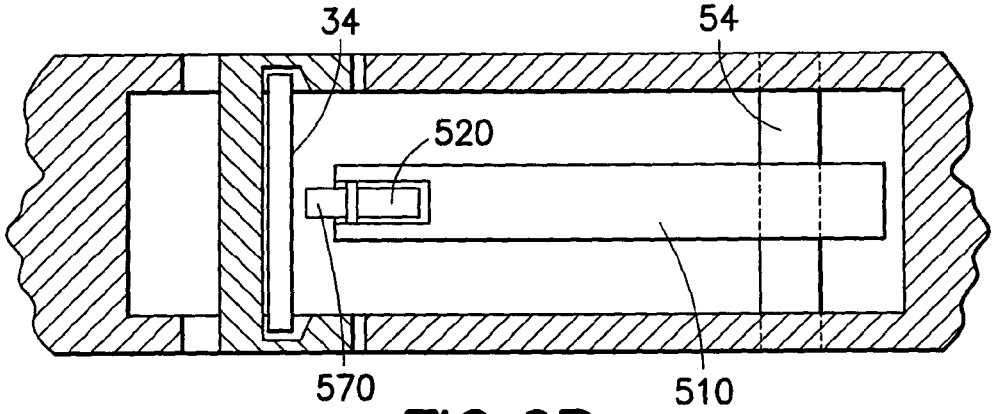

Referring to FIGS. 5B and 6B, the controller 66 (FIG. 9), is activated by the one or more sensors 63, 96, 97. Activation by the one or more sensors 63, 96, 97 may also cause controller 66 to determine that a round has been fired and to count or record the number of rounds fired per burst or per a particular time period. After a predetermined period of time, during which the hammer 510 has been retained by the solid-state full auto sear 34, the controller 66 sends a voltage to the solid-state full auto sear 34, causing it to momentarily assume its flattened, charged, hammer-release condition. This causes a subsequent round to be fired.

It is this predetermined period of time during which the hammer 510 remains retained by the solid state full auto sear 34, which determines the cyclic rate of fire of the weapon in full-auto or burst mode. The released hammer 510 now causes a subsequent round to be fired, thereby causing the bolt assembly 24 and hammer 510 to cycle once again.

Figure 5C:
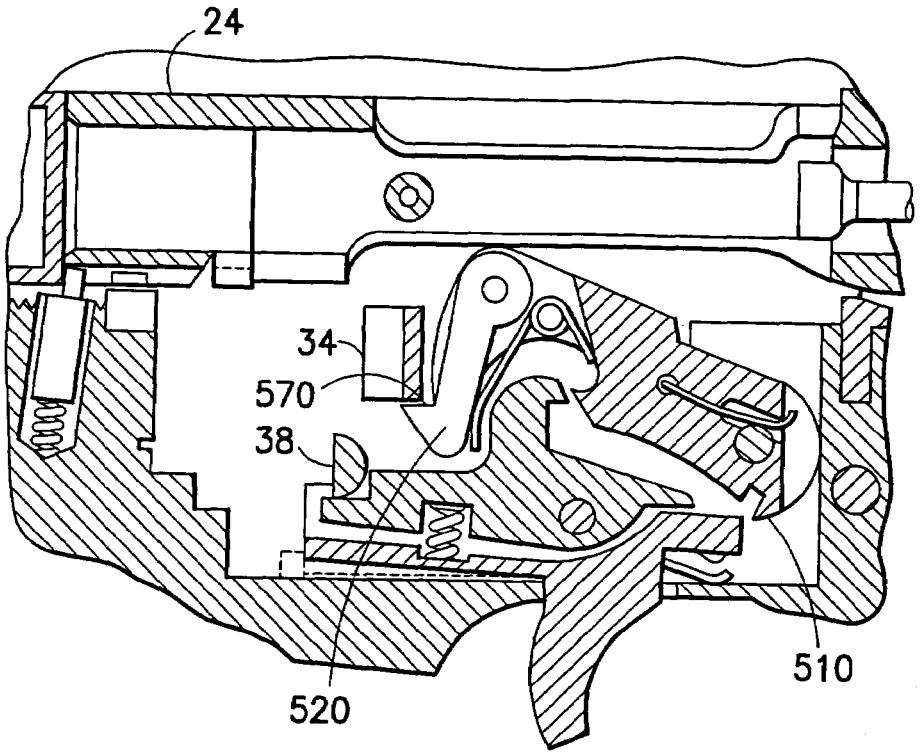
Figure 6C:
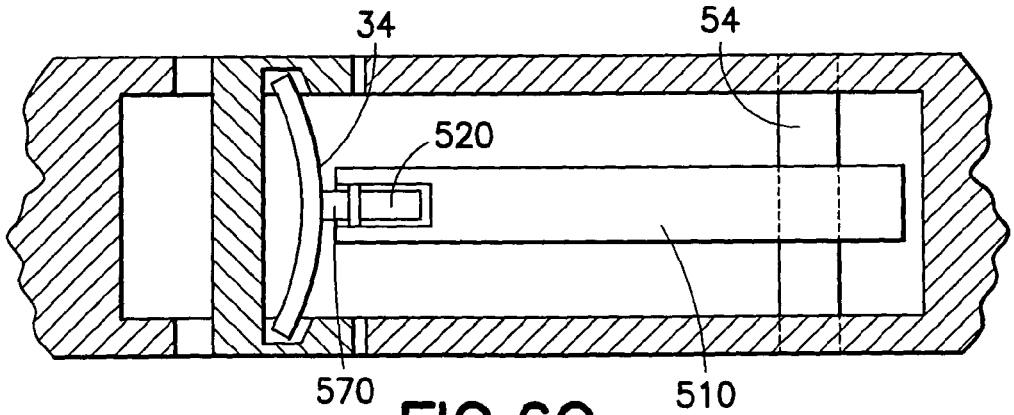

Referring to FIGS. 5C and 6C, upon release of the hammer 510, the controller 66 discontinues the charge to the solid-state full auto sear, allowing it to return to its bowed, uncharged, hammer-retaining condition. A subsequent round having been fired, the hammer 510 is once again momentarily retained by the solid-state full auto-sear 34.

This sequence of events will continue to repeat as long as the trigger 30 remains in a pulled or firing position, until all rounds in the magazine have been discharged, or until a predetermined number of rounds have been fired. Thus, a burst may be controlled such that any number of rounds may be fired per burst. For example, a burst may comprise firing zero, one, two, three, or any number of desired rounds, at any desired rate.

Figure 5D:
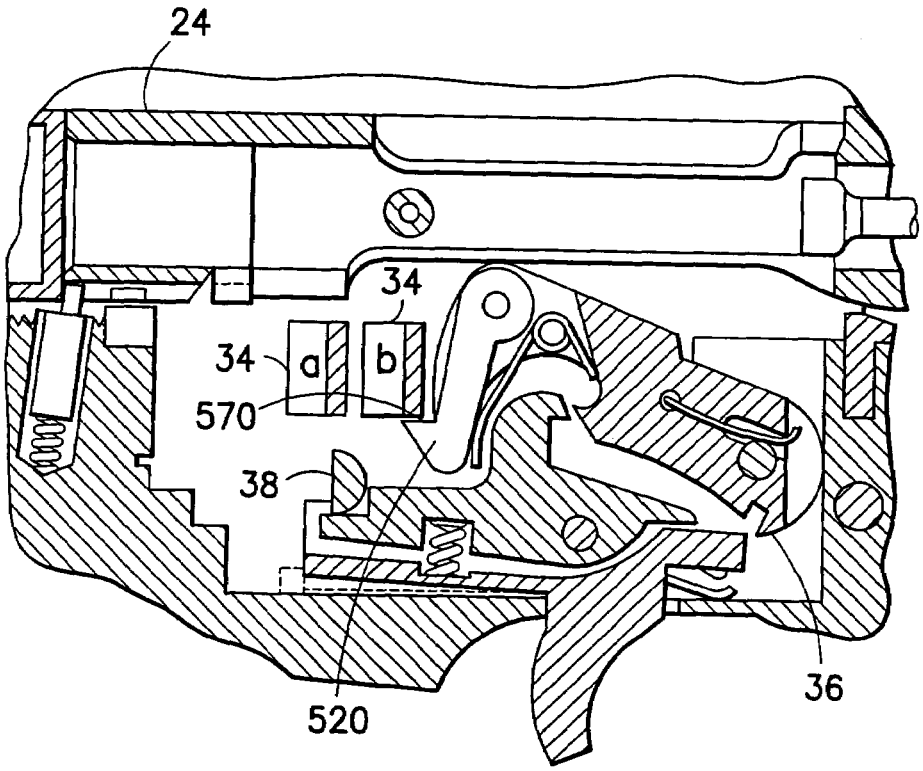
Figure 6D:
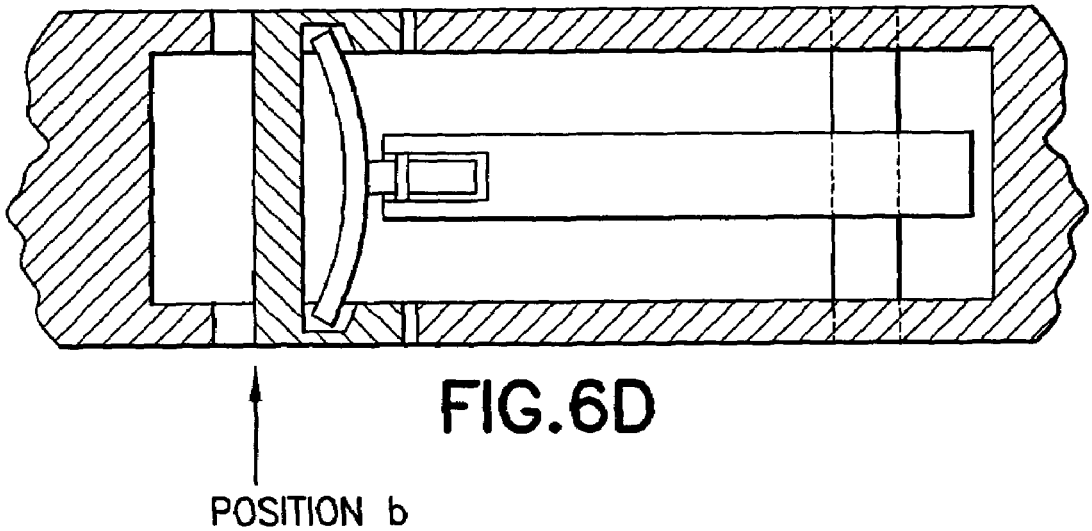
Figure 6E:
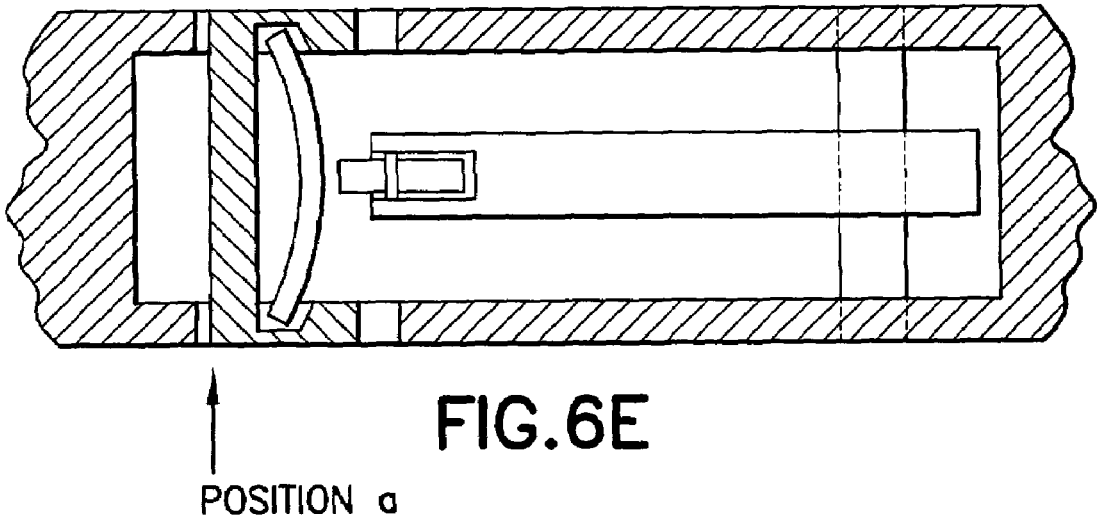

FIGS. 5D, 6D, and 6E show the solid state full auto sear 34 in a mechanical semi-auto position (a) and a full auto position (b). Because the solid-state full-auto-sear 34, in this embodiment, will engage the hammer 510 in its uncharged condition, it must be relocated out of the path of hammer 510 in order for the mechanical semi-auto mode to be employed. This may be accomplished by movably coupling frame 68 to the selector switch 38. In one embodiment, this relocation may be accomplished in a manner analogous to relocating a full-auto-sear on a conventional M16/M4 rifle for semi-auto fire using the selector.

Figure 5E:
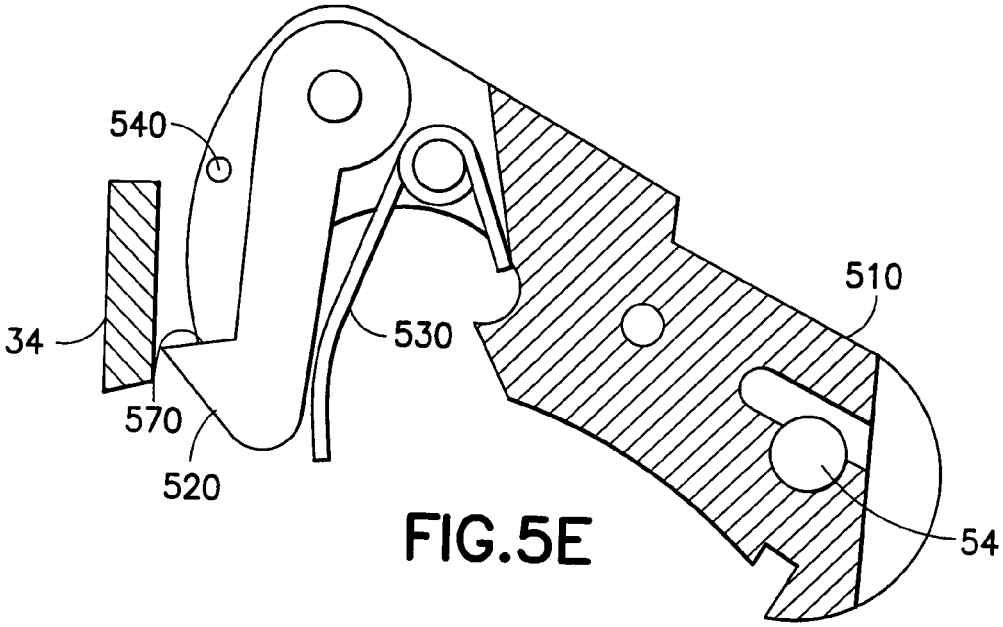
FIGS. 5E–5G are enlarged cross sectional views showing the hammer bent in detail.
Figure 5F:
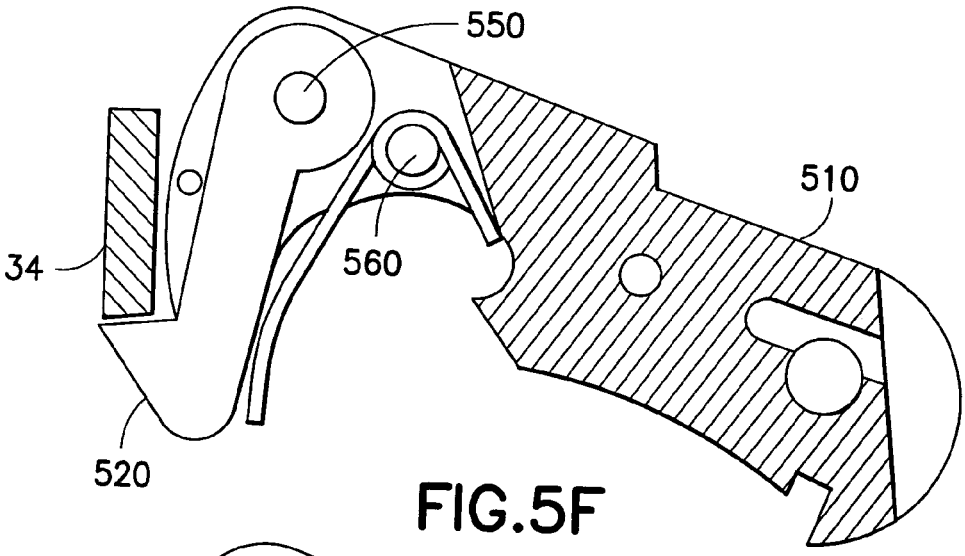
Figure 5G:
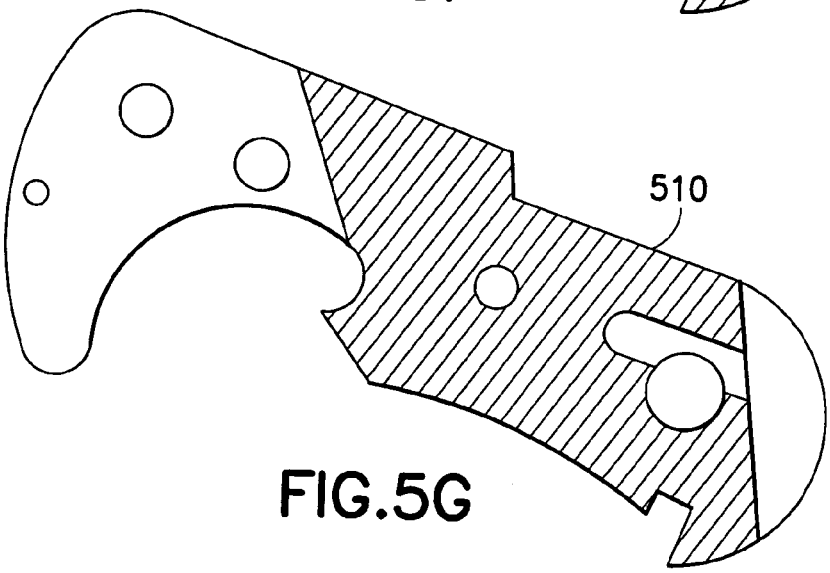

As mentioned above, the embodiments shown in FIGS. 5A–5D and 6A–6E employ a hammer 510 having a retractable hammer bent 520. An embodiment of the hammer 510 with the retractable hammer bent 520 shown in detail is illustrated in FIGS. 5E–5G. The retractable hammer bent 520 permits the solid-state full auto sear position/condition sequence to begin in a hammer engaging position. The retractable hammer bent 520 allows the hammer 510 to complete its full rotation unobstructed by the solid-state full auto sear 34. A retractable hammer bent 520 could be advantageously utilized in the embodiments shown in FIGS. 3A–3C, 4A, and 4B if there are problems with the timing of the solid-state full auto sear 34, specifically should the solid-state full auto sear 34 return to its hammer engagement position before the hammer 26 has reached full rotation.

FIG. 5E illustrates the hammer 510 rotating rearwards and shows the retractable hammer bent 520 being forced into a retracted position by the solid state full auto sear 34 as the hammer bent 520 rotates past the solid state full auto sear 34. The retractable hammer bent 520 may be rotatably mounted to the hammer 510 using a pivot pin 550. The hammer 510 also includes a hammer bent return spring 530 which may be positioned by a pin 560 and may also include a hammer bent stop pin 540, which limits the hammer bent's extended motion.

In one embodiment, the retractable hammer bent 520 and hammer bent return spring 530 may be retrofitted to a weapon, for example, a standard M4/M16 hammer part or any other weapon hammer.

FIG. 5F shows the hammer 510 at full rotation with the hammer bent 520 having now snapped back into a neutral solid state full auto sear engaging position, causing the hammer 510 to be retained by the solid state full auto sear 34.

FIG. 5G shows a view of one embodiment of hammer 510 minus the retractable hammer bent 520 and hammer bent return spring 530.

Figure 7A:
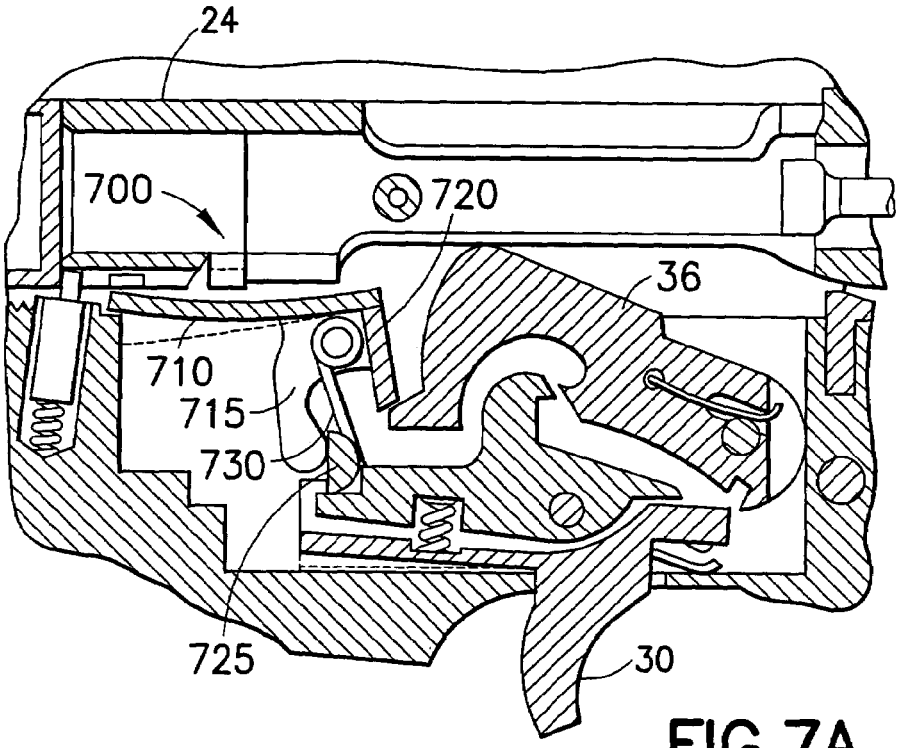
FIGS. 7A–7G are further cross sectional views illustrating the operation and details of another embodiment of the present invention.

FIG. 7A shows a cross sectional view of a portion of the lower receiver 28 and trigger mechanism 26, including another embodiment of the solid state full auto sear 700 in a hammer retaining, uncharged condition and position.

This embodiment of the solid-state full auto sear 700 may include a piezoelectric device 710, a type of mechanical full auto sear 715, and a front extension 720. The piezoelectric device 710, mechanical full auto sear 715, and the front extension 720 may be attached together, for example by bonding, to form a single unit.

In this embodiment, the piezoelectric device 710 is a generally flat shaped member, which is bowed in its uncharged state and flat in a charged state, for example when a voltage is applied to it. In this embodiment, the piezoelectric device 710 is shown in an uncharged, bowed, hammer-retaining condition. In alternate embodiments, the piezoelectric device 710 may have any suitable shape.

In this view of the lower receiver 28 and trigger mechanism 26, a first round has been mechanically fired, the bolt assembly 24 has cycled and caused the hammer 36 to engage and be retained by the solid-state full auto sear. The selector switch 725 is in a full-auto or burst fire position, and the trigger 30 has been mechanically disengaged from the hammer 36, which in turn has struck the firing pin and caused a first mechanical discharge of the weapon 10. The bolt assembly 24 has traveled to its most rearward position and returned to battery, having rotated the hammer 36 to its most rearward position in the process, thus causing the hammer 36 to be retained by the solid state full auto sear 700.

Sometime between the initial mechanical release of the hammer 36 and its rotation to its most rearward, cocked position, one or more of the sensors 63, 96, 97 are activated by a specific event, for example, movement or contact by the bolt assembly 24, hammer 36, or trigger 30.

Figure 7B:
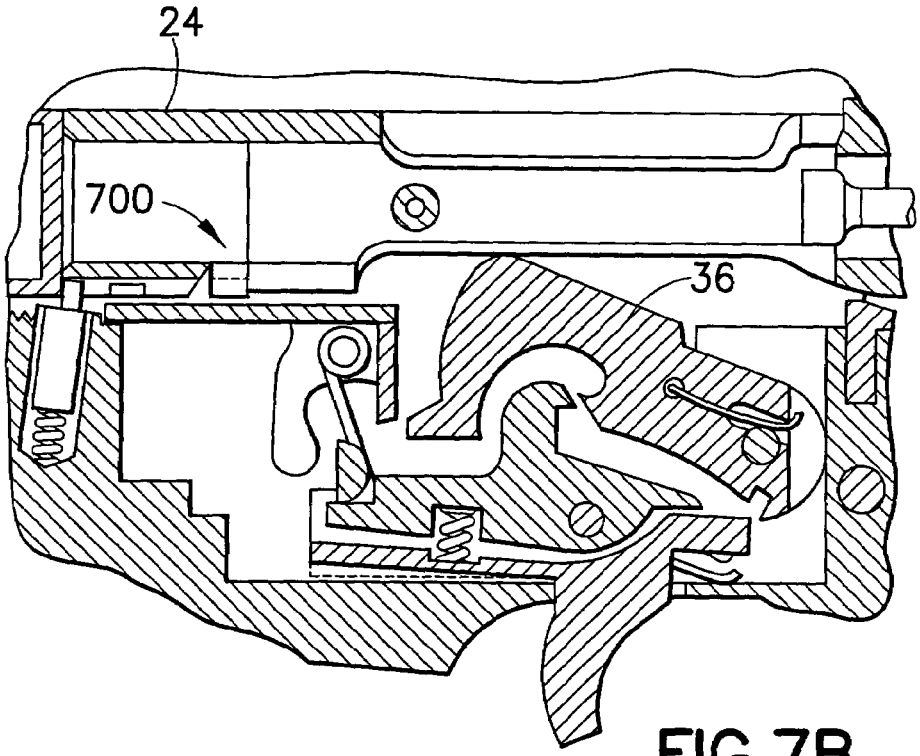

Turning now to FIG. 7B, the controller 66 (FIG. 9), is activated by the one or more sensors 63, 96, 97. Activation by the one or more sensors 63, 96, 97 may also cause controller 66 to determine that a round has been fired and to count or record the number of rounds fired per burst or per a particular time period. After a predetermined period of time, during which the hammer 36 has been retained by the solid-state full auto sear 700, the controller 66 sends a voltage to the solid-state full auto sear 700, causing it to momentarily assume its flattened, charged, hammer-release condition. This causes the solid-state full auto sear 700 to move out of engagement with the cocked hammer 36, causing a subsequent round to be fired. Although the solid-state full auto sear 700 is shown in this embodiment to be pivotably mounted, in alternate embodiments it may slidably mounted, or otherwise mounted so as to be able to move out of engagement with hammer 36.

It is this predetermined period of time during which the hammer 36 remains retained by the solid state full auto sear 700 that determines the cyclic rate of fire of the weapon 10 in either full-auto mode or burst mode. The controller 66, in combination with the solid-state full auto sear 34, may operate at any firing rate up to the natural, uncontrolled cyclic rate of the weapon. The hammer 36, now released, causes a subsequent round to be fired, causing the bolt assembly 24 and hammer 36 to once again cycle and the aforementioned sensor to once again be activated.

Upon release of the hammer 36, the controller 66 discontinues the charge to the solid-state full-auto-sear 700, allowing it to return to its bowed, uncharged, hammer-retaining condition. The hammer 36 is once again retained by the solid-state full auto sear 700 as shown in FIG. 7A. This sequence of events will continue to repeat as long as the trigger 30 remains in a pulled or firing position, until all rounds in the magazine have been discharged, or until a set number of rounds have been fired. Thus, a burst may be controlled such that any number of rounds may be fired per burst. For example, a burst may comprise firing zero, one, two, three, or any number of desired rounds, at any desired rate.

Figure 7C:
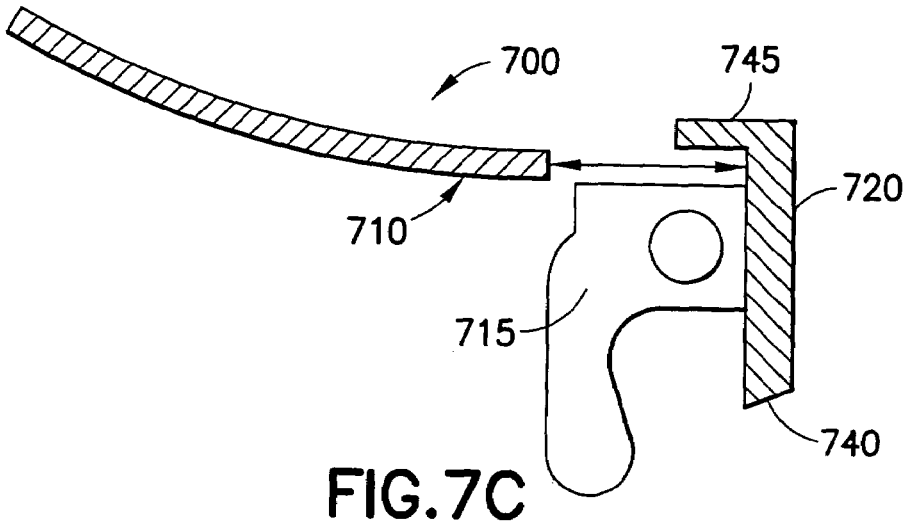
Figure 7D:
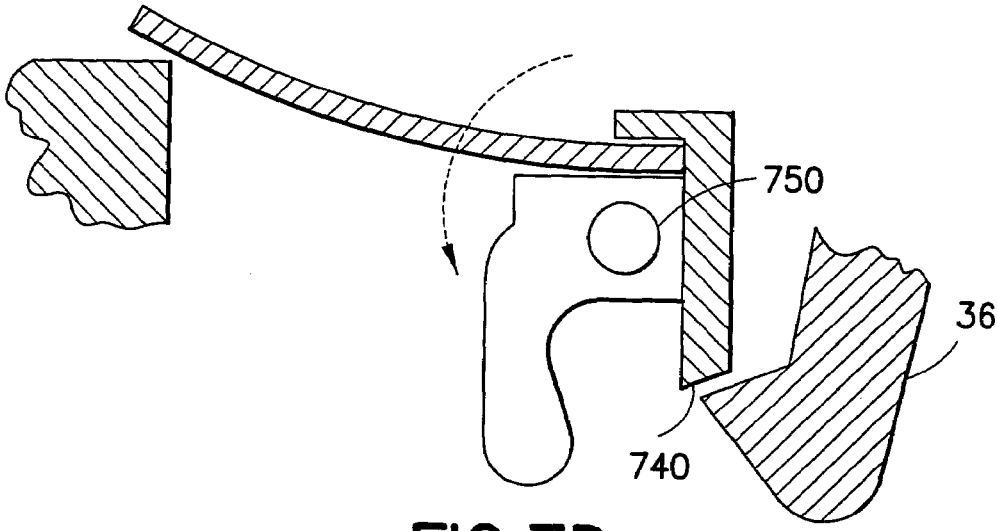
Figure 7E:
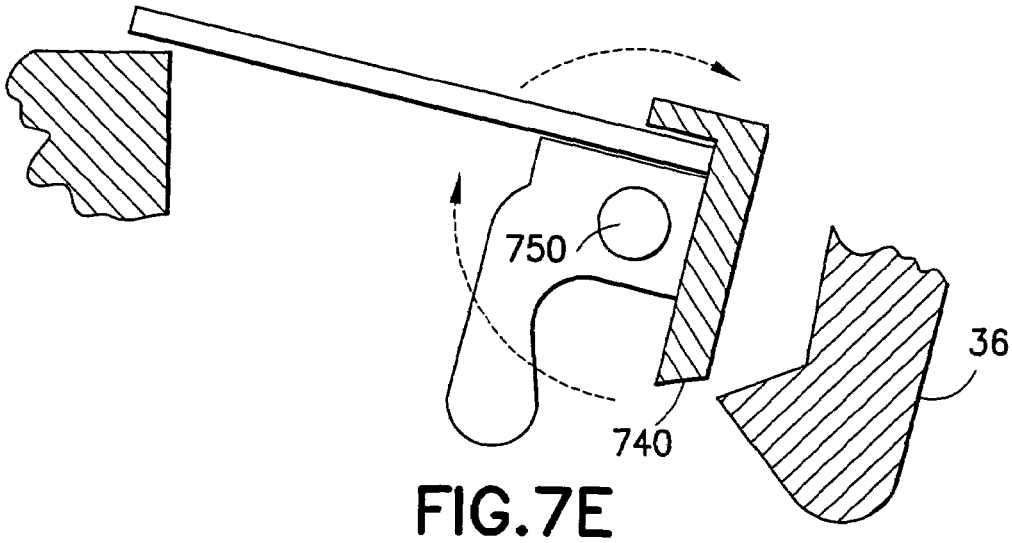

FIGS. 7C–7E show one embodiment of the solid-state full auto sear 700 in detail. As mentioned above, the solid-state full auto sear 700 may comprise a piezoelectric device 710, a type of mechanical full auto sear 715, and a front extension 720. The front extension 720 may include a hammer engagement surface 740 and a rearward extending member 745. As shown in FIG. 7C, the solid state full auto sear 700 may be assembled by positioning one end of the piezoelectric device under a lip of the rearward extending member 745 and attaching the piezoelectric device 710, mechanical full auto sear 715, and front extension 720 together by any suitable means such as bonding or fastening.

As shown in FIG. 7D, the piezoelectric device 710 may assume a bowed shape when uncharged, and may apply a spring force, causing the solid state full auto sear 700 to move, in this case to rotate about a pivot 750, positioning the hammer engagement surface 740 in the path of the hammer 36. As shown in FIG. 7E, when charged, the piezoelectric device 710 may assume a flat shape, causing the solid state full auto sear 700 to rotate about the pivot 750 in the opposite direction, moving the hammer engagement surface 740 out of the path of the hammer 36.

Figure 7F:
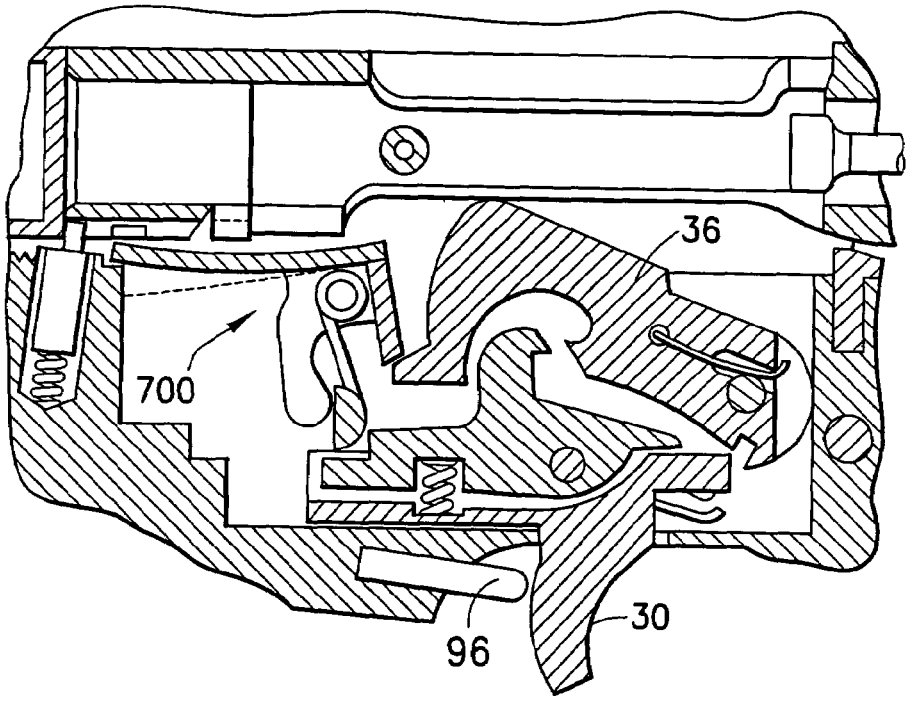
Figure 7G:
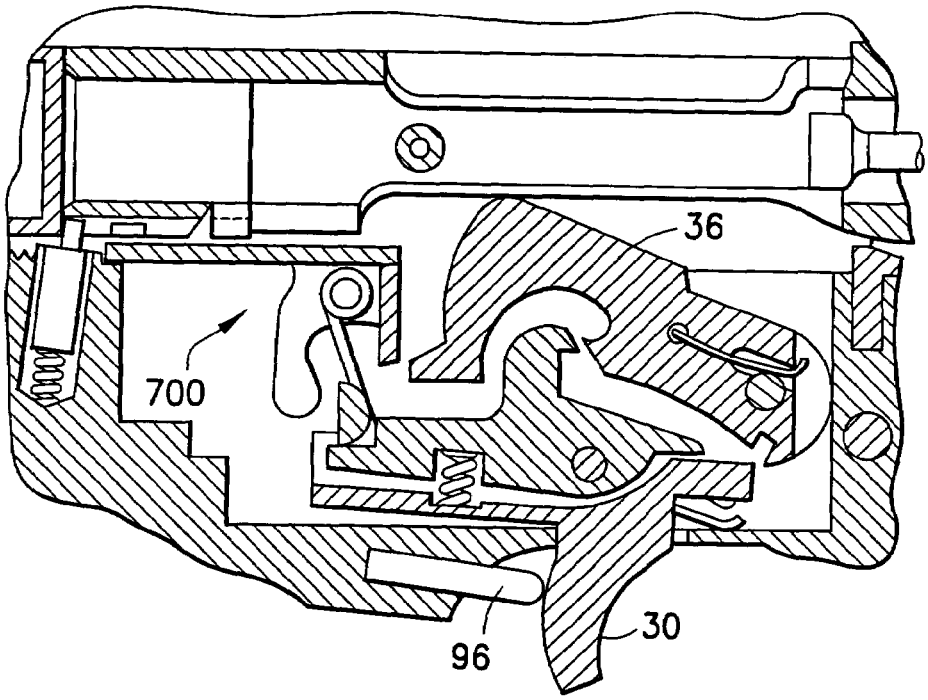

FIGS. 7F and 7G illustrate an embodiment of the present invention that provides an electromechanical semi-auto mode of fire. Such a capability allows for an extremely fine, light, and virtually friction free trigger release which is highly advantageous for accurate target and sniper shooting.

Referring to FIG. 7F, a cross sectional view of a portion of the lower receiver 28 and trigger mechanism 26 is shown where a round has been mechanically fired and the hammer 36 has been retained by the solid state full auto sear 700, which is shown in its uncharged, hammer retaining condition. In this embodiment, for the electromechanical semi auto mode of fire, the controller 66 (FIG. 9) does not automatically cause a subsequent round to be fired and the hammer 36 remains retained by the solid-state full auto sear 700. This embodiment includes a trigger sensor 96, which may be located just behind and beneath the trigger 30. The trigger 30 has been pulled once and released.

Turning now to FIG. 7G, the trigger 30 is pulled a second time and in the process, activates the trigger sensor 96. The activation of trigger sensor 96 causes the controller 66 to send a charge to the solid-state full auto sear 700. The solid-state full auto sear 700 rotates out of engagement with the hammer 36 and a next round is fired. The controller 66 discontinues the charge to the solid-state full auto-sear 700 in time for it to once again retain the hammer 36 as the hammer 36 once again rotates rearward and down. Thus, in this embodiment, the trigger pull is mechanically separate from the actual firing of the weapon, allowing for an ultra sensitive, electronically released, firing mechanism. This type of mechanism may also be referred to as a "target" or "sniper" trigger mechanism.

In essence, the electromechanical semi auto mode of fire is a burst-fire mode, in which the predetermined number of rounds to be fired is set to one. The first round may still be fired mechanically, while the subsequent semi-auto rounds are fired electro-mechanically utilizing the solid-state full-auto-sear 700.

In the embodiments shown in FIGS. 7A–7G, a retractable hammer bent as shown in FIGS. 5D–5G may not be required as the solid-state full auto sear 700 may be spring loaded. However, one might still consider employing a retractable hammer bent in order to save impact wear on the piezoelectric component 710 of the solid-state full auto sear 700, which would most likely repeatedly snap against a frame stop-surface each time the hammer 36 engaged the solid-state full auto sear 700.

Figure 8:
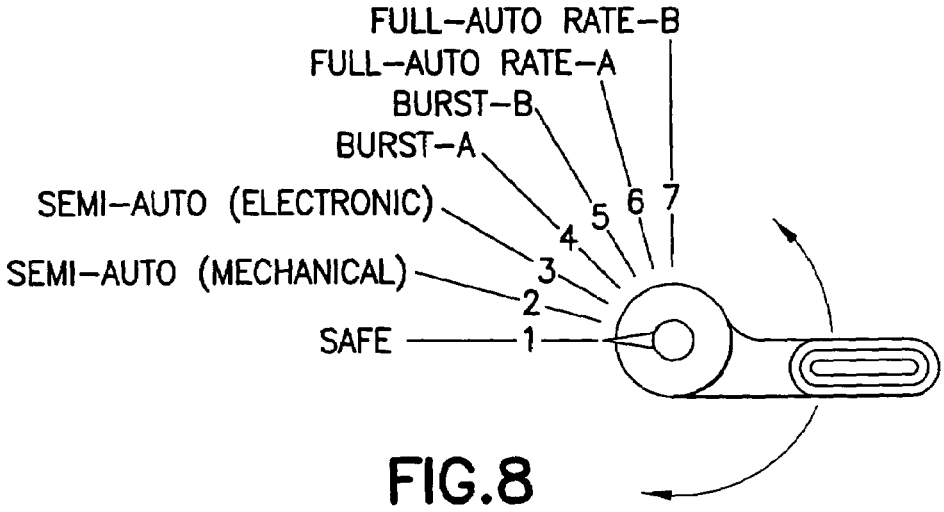
FIG. 8 shows various selector switch settings.

With the implementation of the embodiments of the solid-state full auto sear 34, 700 described above, the selector switch may be selectable among several firing options and combinations of firing options. If the present invention is retrofitted to an existing weapon, some pre-existing firing options, for example Safe and Semi-Auto-Mechanical, may remain constant or unaffected. Some illustrative selector options and potential positions are depicted in FIG. 8. They may include: position 1, SAFE: the traditional, locked, cannot fire position; position 2, SEMI-AUTO, MECHANICAL: for semi-auto fire, utilizing the traditional mechanical sear linkage between the trigger and hammer to release the hammer from a cocked position; and, position 3, SEMI-AUTO, ELECTRO-MECHANICAL: as described and illustrated in the embodiment shown in FIGS. 7A–7E utilizing the solid-state full-auto-sear for semi-auto target and sniper shooting.

Additional options may include: position 4, BURST-A: for a two, three (or whatever number of rounds) burst of fire at a predetermined rate of fire at or below the natural rate of fire of the weapon; position 5, BURST-B: an alternative to BURST-A with possibly a different number of rounds and/or a different rate of fire; position 6, FULL-AUTO RATE-A: for full-auto fire at any rate at or below the natural rate of fire of the weapon; and, position 7, FULL-AUTO RATE-B: for an alternative rate of fire to FULL-AUTO RATE-A.

The present invention is advantageous in that an electrically controlled system allows rates of fire to be easily selected or adjusted. Unlike fully mechanical automatic firing mechanisms, with the present invention, the weapon 10 can provide any suitable rate of fire at or below the natural rate, such as 300, 400, 500, etc. rounds per minute. Such a controlled rate of fire may result in more efficient use of ammunition, and help to eliminate muzzle climb or wander. As mentioned above, the controller 66 could also be preprogrammed to fire only a burst, such as a one, two, or three round burst. The present invention, already incorporating electronic circuitry and sensors, can easily be made to include the registration of the number of rounds fired, which can more accurately signal scheduled maintenance procedures and parts replacement procedures, which are currently scheduled relative to the number of rounds fired. A further important advantage is that the designing of the size, weight and travel of the weapon components can now be accomplished without regard to the potential effect on the final rate-of-fire. Both the determination and the actual setting of the optimal rate-of-fire for a particular weapon design can now be treated as a totally independent and separate exercise.

Also, both the simplicity and extreme compactness of the present invention, make retrofitting such a device to an existing weapon design both practical and cost effective with an absolute minimum impact by way of alteration to the already tested and proven weapon design.

It should be understood that the foregoing description is only illustrative of the invention. Various alternatives and modifications can be devised by those skilled in the art without departing from the invention. Accordingly, the present invention is intended to embrace all such alternatives, modifications and variances, which fall within the scope of the appended claims.

What is claimed is:

1. A firing mechanism comprising:

a hammer;

an electrical, one-piece, solid-state piezoelectric full auto sear positioned to directly engage the hammer in a first electrical state and to disengage from the hammer in a second electrical state; and a controller connected to the electrical, one piece, solid-state piezoelectric full auto sear for causing the electrical solid-state full auto sear to change from the first electrical state to the second electrical state.

2. The firing mechanism of claim 1, wherein the controller includes circuitry for causing the electrical sear to change from the first electrical state to the second electrical state at a predetermined rate.

3. The firing mechanism of claim 1, wherein the controller includes circuitry for causing the electrical sear to change from the first electrical state to the second electrical state a predetermined number of times.

4. The firing mechanism of claim 1, wherein the controller includes circuitry for causing the electrical sear to change from the first electrical state to the second electrical state for a predetermined period of time.

5. The firing mechanism of claim 1, wherein the controller includes circuitry for counting the number of rounds fired.

6. The firing mechanism of claim 1, wherein each of the first and second electrical states are one of a charged state and an uncharged state.

7. The firing mechanism of claim 1, wherein the hammer includes a retractable hammer bent for engagement with the electrical sear.

8. The firing mechanism of claim 1, wherein the piezoelectric device assumes a flat shape in the first electrical state and a bowed shape in the second electrical state.

9. The firing mechanism of claim 1, wherein the electrical sear comprises:

a piezoelectric device;

a mechanical full auto sear attached to the piezoelectric device; and a front extension attached to the mechanical full auto sear.

10. The firing mechanism of claim 9, wherein in the first state the piezoelectric device moves the electrical sear in a first direction to cause the front extension to engage the hammer.

11. The firing mechanism of claim 9, wherein in the second state the piezoelectric device moves the electrical solid-state full auto sear to cause the front extension to disengage from the hammer.

12. The firing mechanism of claim 1, further comprising a trigger sensor, wherein the controller causes the electrical solid-state full auto sear to change from the first electrical state to the second electrical state in response to activation of the trigger sensor.

13. A firing mechanism comprising:

a hammer;

an electrical solid-state full auto sear positioned to engage the hammer in a first electrical state and to disengage from the hammer in a second electrical state; and a controller connected to the electrical solid-state full auto sear for causing the electrical solid-state full auto sear to change from the first electrical state to the second electrical state, wherein the electrical solid-state full auto sear is a one-piece member piezoelectric device, and wherein the piezoelectric device assumes a bowed shape in the first electrical state and a flat shape in the second electrical state.

14. A method of firing a weapon comprising:

directly engaging a hammer with an electrical, one piece, solid-state piezoelectric full auto sear in a first electrical state;

disengaging the electrical, one piece, solid-state full auto sear from the hammer in a second electrical state; and controlling a change from the first electrical state to the second electrical state to control the firing of the weapon.

15. The method of claim 14, further comprising causing the electrical solid-state full auto sear to change from the first electrical state to the second electrical state at a predetermined rate.

16. The method of claim 14, further comprising causing the electrical solid-state full auto sear to change from the first electrical state to the second electrical state a predetermined number of times.

17. The method of claim 14, further comprising causing the electrical sear to change from the first electrical state to the second electrical state for a predetermined period of time.

18. The method of claim 14, further comprising counting the number of rounds fired.

19. A firing mechanism comprising:

a hammer;

an electrical, one piece, solid-state piezoelectric full auto sear that changes shape between a first and second electrical state to directly engage the hammer in the first electrical state and to disengage from the hammer in the second electrical state; and a controller connected to the electrical one piece, solid-state piezoelectric full auto sear for causing the electrical sear to change from the first electrical state to the second electrical state.

* * * * *